US009109485B2

(12) United States Patent
Lee

(10) Patent No.: US 9,109,485 B2
(45) Date of Patent: Aug. 18, 2015

(54) METHOD OF CONTROLLING LOW-PRESSURE FUEL PUMP FOR GDI ENGINE

(75) Inventor: Bum Ky Lee, Suwon-si (KR)

(73) Assignees: HYUNDAI MOTOR COMPANY, Seoul (KR); KIA MOTORS CORP., Seoul (KR)

( * ) Notice: Subject to any disclaimer, the term of this patent is extended or adjusted under 35 U.S.C. 154(b) by 423 days.

(21) Appl. No.: 13/545,725

(22) Filed: Jul. 10, 2012

(65) Prior Publication Data

US 2013/0138325 A1 May 30, 2013

(30) Foreign Application Priority Data

Nov. 30, 2011 (KR) ..... 10-2011-0126765

(51) Int. Cl.
*F02D 1/02* (2006.01)
*F01N 3/023* (2006.01)
*F01N 3/025* (2006.01)

(52) U.S. Cl.
CPC ..... *F01N 3/0231* (2013.01); *F01N 3/025* (2013.01); *F01N 2330/32* (2013.01); *F01N 2330/48* (2013.01); *F01N 2330/60* (2013.01)

(58) Field of Classification Search
CPC ..... F02D 1/02; F02D 41/00; F02D 41/3082; F02M 63/0225
USPC ..... 123/179.16, 179.17, 446, 447, 458, 123/490, 494; 701/103
See application file for complete search history.

(56) References Cited

U.S. PATENT DOCUMENTS

| | | | | |
|---|---|---|---|---|
| 2003/0131826 | A1* | 7/2003 | Smith et al. | 123/446 |
| 2005/0126188 | A1* | 6/2005 | Winter | 62/50.1 |
| 2010/0274467 | A1* | 10/2010 | Hayami | 701/103 |
| 2011/0106393 | A1 | 5/2011 | Pursifull | |

FOREIGN PATENT DOCUMENTS

| | | | |
|---|---|---|---|
| JP | 2011-21565 | A | 2/2011 |
| JP | 2011-021565 | A | 2/2011 |
| KR | 10-2009-0100865 | A | 9/2009 |
| KR | 10-2011-0062641 | A | 6/2011 |

* cited by examiner

*Primary Examiner* — Stephen K Cronin
*Assistant Examiner* — Xiao Mo
(74) *Attorney, Agent, or Firm* — Morgan, Lewis & Bockius LLP

(57) ABSTRACT

A method of controlling a low-pressure fuel pump for a GDI engine includes setting predetermined driving conditions that affect a drivability of the GDI engine in situations that are generated in a vehicle in which the GDI engine is mounted, open-loop controlling the low-pressure fuel pump when one or more of the predetermined driving conditions occur, and when none of the predetermined driving conditions occurs, close-loop controlling the low-pressure fuel pump according to a signal from a fuel pressure sensor such that a target fuel pressure provided from an engine controller is pursued.

6 Claims, 4 Drawing Sheets

METHOD OF CONTROLLING LOW-PRESSURE FUEL PUMP FOR GDI ENGINE

CROSS-REFERENCE TO RELATED APPLICATION

The present application claims priority of Korean Patent Application Number 10-2011-0126765 filed on Nov. 30, 2011, the entire contents of which application are incorporated herein for all purposes by this reference.

BACKGROUND OF INVENTION

1. Field of Invention

The present disclosure relates to a method of controlling a low-pressure fuel pump for a gasoline direct injection (GDI) engine. More particularly, it relates to technologies which can increase fuel efficiency of a vehicle by variably controlling a low-pressure pump and ensure driving stability of a vehicle by coping with any problematic situation that may occur while increasing the fuel efficiency.

2. Description of Related Art

Since a GDI engine injects a high pressure of fuel into a combustion chamber, a fuel supplying system, including a low-pressure system and a high-pressure system, directly injects fuel through an injector to a combustion chamber, where the high-pressure system gives greater pressure to primary compressed fuel by the low-pressure system.

A low-pressure system of the prior art is typically operated in the manner of driving a low-pressure fuel pump to exhaust fuel at a designed maximum flow rate in the state of maintaining a constant fuel pressure. Because the constant fuel pressure and flow rate are based on the state of significantly coping with various changes caused by a driving situation of a vehicle in the high-pressure system, unnecessary fuel pressure and flow rate are continuously formed in a conventional situation, such that the low-pressure fuel pump is always operated in the overworking state.

Since the low-pressure fuel pump is overworked more than necessary for a GDI fuel supply system, unnecessary energy consumption is caused. Thus, this results in deteriorating fuel efficiency.

Therefore, if a low-pressure fuel pump is variable controlled to provide necessary fuel pressure and flow rate that are suitable to a driving situation of a vehicle in the low-pressure system, energy consumed by the low-pressure fuel pump is reduced, such that fuel efficiency of the vehicle is improved.

FIG. 1 is a block diagram illustrating a low-pressure system of a GDI engine which uses a conventional brushless direct current (BLDC) motor for a low-pressure fuel pump. When an engine controller 500 provides a target fuel pressure to a pump controller 502, the pump controller 502 receives a signal which is fed back through a fuel pressure sensor 506 installed toward a low-pressure fuel pump 504 and controls the low-pressure fuel pump 504 by a PID (Proportional, Integral, Derivative) control, such that the target fuel pressure is pursued.

In view of the pump controller 502, as shown in FIG. 2, the pump controller 502 receives only the target fuel pressure of a low-pressure side from the engine controller 500 and a fuel pressure measured and fed back through the fuel pressure sensor 506, and feed-back controls the low-pressure fuel pump 504.

The above-described fuel pressure control that copes with an amount of consumed fuel is coped in real time if possible and is configured to be able to vary a fuel rate. Thus, compared with the prior art in which a maximum flow rate is always formed, the fuel pressure control reduces a current consumed in the low-pressure fuel pump 504, such that it is achieved to improve fuel efficiency.

However, in case of a GDI engine, problems occur when flow rate provided from a low-pressure system is insufficient or when an insufficient fuel pressure of the low-pressure side, compared with a pressure practically necessary for a high-pressure system, is formed under certain condition due to an unsuitably set target fuel pressure of a low-pressure side. Such problems include engine stop, lighting of an engine warning light, overload rash, poor acceleration.

The information disclosed in this Background section is only for enhancement of understanding of the general background of the invention and should not be taken as an acknowledgement or any form of suggestion that this information forms the prior art already known to a person skilled in the art.

SUMMARY OF INVENTION

The present application has been made in an effort to solve the above-described problems associated with prior art. One aspect of the present application provides a method of controlling a low-pressure fuel pump for a GDI engine which pursues improvement of vehicle fuel efficiency by variably controlling a low-pressure fuel pump of the low-pressure system in a fuel supplying system. The fuel supplying system for the GDI engine includes a low-pressure system and a high-pressure system.

Another aspect of the present application provides a method of controlling a low-pressure fuel pump for a GDI engine which can control the low-pressure fuel pump through coping with each type of problems during an engine operation in particular circumstances that may be caused by variable controlling the low-pressure fuel pump in an effort to increase fuel efficiency. The present application provides ultimately improved salability of a vehicle by ensuring driving stability of the GDI engine as well as by further improving fuel efficiency of a vehicle in which the GDI is installed.

In accordance with various aspects of the present application, there is provided a method of controlling a low-pressure fuel pump for a GDI engine. The method comprises setting predetermined driving conditions that affect a drivability of the GDI engine in situations that are generated in a vehicle in which the GDI engine is mounted, open-loop controlling the low-pressure fuel pump when one or more of the predetermined driving conditions occur, and when none of the predetermined driving conditions occurs, close-loop controlling the low-pressure fuel pump according to a signal from a fuel pressure sensor such that a target fuel pressure provided from an engine controller is pursued.

It should be understood that the term "vehicle" or "vehicular" or other similar terms as used herein are inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

The methods and apparatuses of the present invention have other features and advantages which will be apparent from or are set forth in more detail in the accompanying drawings, DETAILED DESCRIPTION serve to explain certain principles of the present invention.

Figure 1:
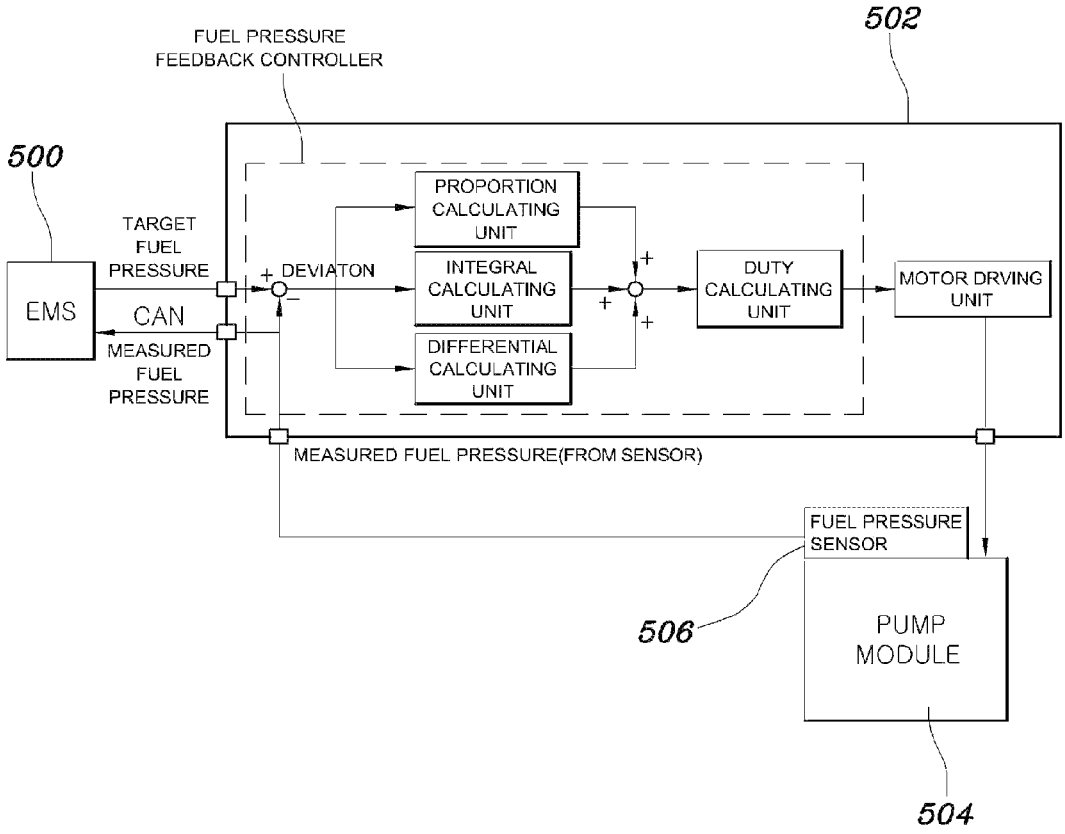
FIG. 1 (Prior Art)
FIG. 1 is a block diagram illustrating an operation of a low-pressure system of a GDI fuel supply system according to the prior art.
Figure 2:
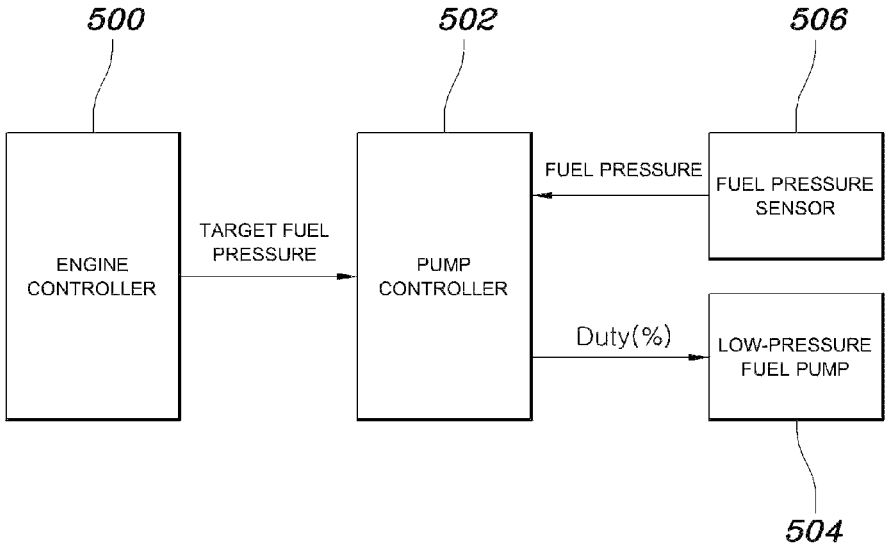
FIG. 2 (Prior Art)
FIG. 2 is a block diagram illustrating performance of a close-loop control by a pump controller of a low-pressure system according to the prior art.

It should be understood that the appended drawings are not necessarily to scale, presenting a somewhat simplified representation of various features illustrative of the basic principles of the application.

In the figures, reference numbers refer to the same or equivalent parts of the present application throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention (s) is/are intended to cover not only the exemplary embodiments, but also various alternatives, modifications, equivalents and other embodiments, which may be included within the spirit and scope of the invention as defined by the appended claims.

Figure 3:
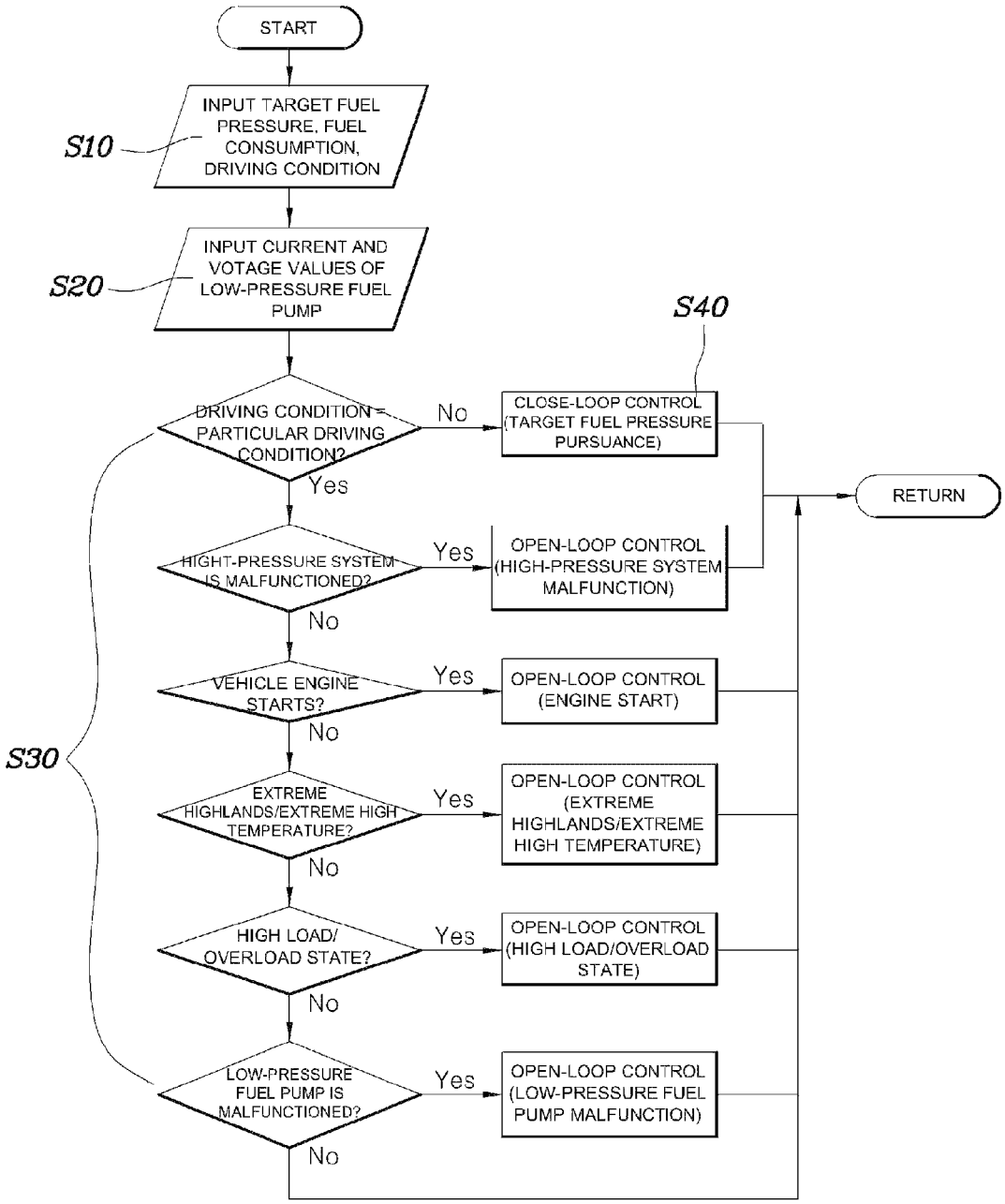
FIG. 3 is a flowchart illustrating an exemplary method of controlling a low-pressure fuel pump for a GDI engine according to the present application.

Referring to FIG. 3, a method of controlling a low-pressure fuel pump for a GDI engine according to various embodiments of the present application includes setting predetermined driving conditions that have an effect on a drivability of the GDI engine in situations that are generated in a vehicle in which the GDI engine is mounted, open-loop controlling the low-pressure fuel pump when one of the predetermined driving conditions occurs, and when any of the predetermined driving conditions do not occur, close-loop controlling the low-pressure fuel pump according to a signal from a fuel pressure sensor such that a target fuel pressure provided from an engine controller is pursued.

In various embodiments, the predetermined driving conditions includes malfunction of a high-pressure system, engine starting, extreme highlands or extreme high temperatures, excessive situations of high loads, and malfunction of the low-pressure fuel pump. The method includes open-loop controlling the low-pressure fuel pump according to a method specially set for each of the predetermined driving conditions when one of the predetermined driving conditions occurs or set for a situation when one or more of the predetermined driving conditions occur.

Figure 4:
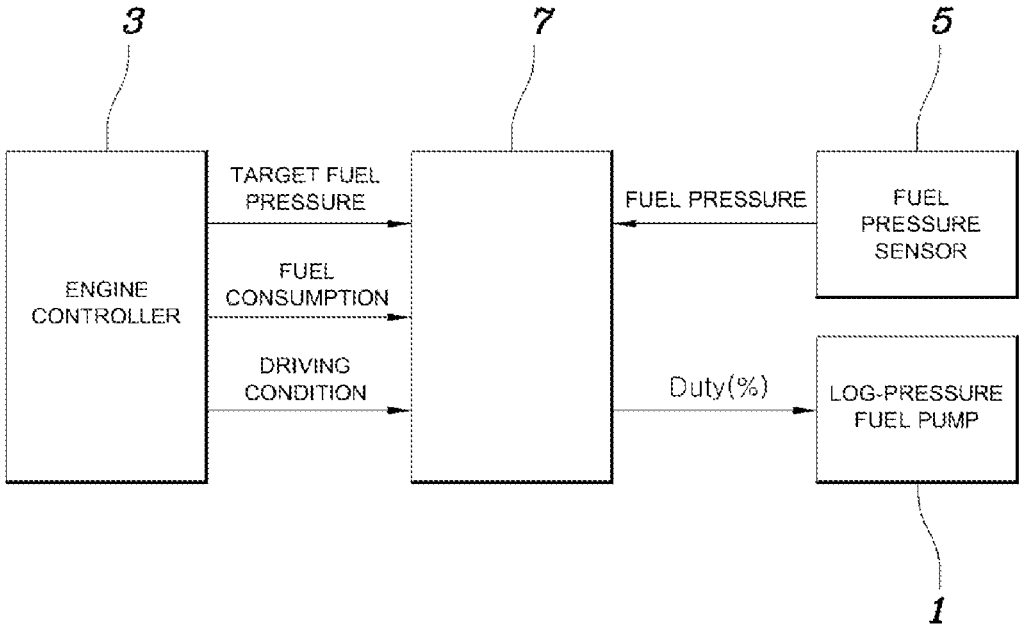
FIG. 4 is a block diagram illustrating an exemplary control of a pump controller according to the present application.

That is, as described above, except for the case that the predetermined driving conditions that have an effect on a drivability of the GDI engine are satisfied, as shown in FIG. 4, a pump controller 7 of a low-pressure system performs a close-loop control operation of controlling the low-pressure fuel pump 1 according to the target fuel pressure of a low-pressure side inputted from the engine controller 3 and the fuel pressure measured directly by the fuel pressure sensor, such that the target fuel pressure is pursued. On the contrary, when the predetermined driving conditions are satisfied, as described above, the pump controller 7 receives information about a driving condition provided from the engine controller 3 and if the driving condition is included in the predetermined driving conditions, performs each open-loop control.

Specifically, when it is determined the malfunction of the high-pressure system of the predetermined driving conditions occurs, a limp-home open-loop control is performed for open-loop controlling the low-pressure fuel pump 1 to allow it to be operated at the maximum flow rate, such that the engine operation is maintained without engine stop.

Further, when it is determined that the driving condition is the engine starting of the predetermined driving conditions, the low-pressure fuel pump 1 may be open-loop controlled at a duty rate of 100% for a predetermined time period, such that driving stability of a vehicle is improved. The predetermined time period may be set as for example, one second.

When it is determined that a driver is diving the vehicle in the extreme highlands or at extreme high temperatures of the predetermined driving conditions, the low-pressure fuel pump 1 is open-loop controlled to allow the low-pressure fuel pump 1 to be operated at the maximum flow rate, such that a stable operating state of the engine is ensured in condition of the extreme highlands or the extreme high temperatures.

When it is determined that the vehicle is in the excessive situations of the predetermined driving conditions due to the high loads and since fuel consumption is rapidly increased, it is difficult to supply fuel at a suitable flow rate by an open-loop controlling way, the open-loop control is performed with reference to the target fuel pressure provided from the engine controller 3 and a current fuel consumption, to prevent shortage of fuel in a high-pressure side of the engine.

When it is determined that since it is difficult to normally operate the low-pressure fuel pump 1, the malfunction of the low-pressure fuel pump 1 of the predetermined driving conditions occurs, the low-pressure fuel pump 1 is open-loop controlled, such that the low-pressure fuel pump 1 is operated at a maximum flow rate.

Here, although the pump controller does not communicate with the low-pressure fuel pump 1 when the low-pressure fuel pump 1 is out of order due to malfunction of the low-pressure fuel pump 1, the low-pressure fuel pump 1 may be operated. The malfunction of the low-pressure fuel pump 1 means the case that it is difficult to adjustably perform the close-loop control for reasons of the malfunction of the fuel pressure sensor 5, etc.

Further, the malfunction of the low-pressure fuel pump 1 of the predetermined driving conditions includes the cases that a voltage value of the low-pressure fuel pump 1 is unsuitable, there is no CAN signal from the engine controller 3, there is no confirmation signal in response to a CAN transmission from a pump controller 7 of a low-pressure system, and fuel pressure deviation of the low-pressure system is equal to or greater than 1 bar. In the above cases, the low-pressure fuel pump 1 may be controlled at the maximum flow rate to ensure moving stability of a vehicle.

Referring to FIG. 3, the pump controller 7 performs receiving information about the target fuel pressure, the fuel consumption and the driving conditions S10, receiving inputs of the current and the voltage of the low-pressure fuel pump 1, determining whether a current driving condition is included in the predetermined driving conditions and open-loop controlling the low-pressure fuel pump 1 according to the determination result S30, and performing the close-loop controlling to achieve the target fuel pressure as in the prior art when the driving condition is not included in the predetermined driving conditions S40.

As disclosed herein, the present application pursues improvement of vehicle fuel efficiency by variably controlling a low-pressure fuel pump of the low-pressure system in a fuel supplying system for the GDI engine that includes a low-pressure system and a high-pressure system. The low-pressure fuel pump is controlled through coping with each type of problems during an engine operation in particular circumstances that may be caused by variable controlling the low-pressure fuel pump in an effort to increase fuel efficiency. The present application provides ultimately improved salability of a vehicle by ensuring driving stability of the GDI engine as well as by further improving fuel efficiency of a vehicle in which the GDI is installed.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A method of controlling a low-pressure fuel pump for a gasoline direct injection (GDI) engine comprising:

setting predetermined driving conditions that affect a drivability of the GDI engine in situations that are generated in a vehicle in which the GDI engine is mounted;

open-loop controlling the low-pressure fuel pump when one or more of the predetermined driving conditions occur;

when none of the predetermined driving conditions occurs, close-loop controlling the low-pressure fuel pump according to a signal from a fuel pressure sensor such that a target fuel pressure provided from an engine controller is pursued, wherein the predetermined driving conditions include malfunction of a high-pressure system, engine starting, highlands or extreme high temperatures, high load conditions, and malfunction of the low-pressure fuel pump; and open-loop controlling the low-pressure fuel pump according to a method specially set in response to a situation when one or more of the predetermined driving conditions occur, wherein malfunction of the low-pressure fuel pump of the predetermined driving conditions includes the cases that a voltage value of the low-pressure fuel pump is unsuitable, there is no CAN signal from the engine controller, there is no confirmation signal in response to a CAN transmission from a pump controller of a low-pressure system, and fuel pressure deviation of the low-pressure system is equal to or greater than 1 bar.

2. The method of claim 1, further comprising:

when it is determined that the high-pressure system of the predetermined driving conditions is out of order, open-loop controlling the low-pressure fuel pump at a maximum flow rate.

3. The method of claim 1, further comprising:

when it is determined that the engine starting is malfunctioned, open-loop controlling the low-pressure fuel pump at a duty rate of 100% for a predetermined time period.

4. The method of claim 1, further comprising:

when it is determined that a driver is driving the vehicle in the highlands or at extreme high temperatures of the predetermined driving conditions, open-loop controlling the low-pressure fuel pump such that the low-pressure fuel pump is operated at a maximum flow rate.

5. The method of claim 1, further comprising:

when it is determined that the vehicle is in the high load conditions of the predetermined driving conditions, open-loop controlling the low-pressure fuel pump with reference to the target fuel pressure provided from the engine controller and a current fuel consumption.

6. The method of claim 1, further comprising:

when it is determined that the low-pressure fuel pump is malfunctioned, open-loop controlling the low-pressure fuel pump at a maximum flow rate.

* * * * *